United States Patent [19]

Killop

[11] Patent Number: 4,467,631

[45] Date of Patent: Aug. 28, 1984

[54] APPARATUS FOR SPLINING THIN-WALL POWER TRANSMISSION SLEEVES

[75] Inventor: James T. Killop, Warren, Mich.

[73] Assignee: Anderson-Cook, Inc., Fraser, Mich.

[21] Appl. No.: 396,188

[22] Filed: Jul. 8, 1982

[51] Int. Cl.[3] ..... B21D 17/04

[52] U.S. Cl. ..... 72/88; 72/420; 72/426; 279/2 A

[58] Field of Search ..... 72/88, 90, 125, 420, 72/370, 361, 426; 269/48.1; 279/2 A, 2 R; 29/159.2

[56] References Cited

U.S. PATENT DOCUMENTS

| | | | |
|---|---|---|---|
| 1,332,798 | 3/1920 | Brown | 72/420 |
| 3,263,536 | 8/1966 | Anthony | 279/2 R |
| 3,272,041 | 9/1966 | Anthony | 279/2 R |
| 3,420,537 | 1/1969 | Walters | 279/2 R |
| 3,761,008 | 9/1973 | Goulder | 269/48.1 |
| 3,793,866 | 2/1974 | Anderson et al. | 72/88 |
| 3,982,415 | 9/1976 | Killop | 72/88 |
| 4,028,922 | 6/1977 | Killop | 72/88 |
| 4,045,988 | 9/1977 | Anderson | 72/102 |
| 4,155,237 | 5/1979 | Jungesjo | 72/88 |
| 4,383,428 | 5/1983 | Jungesjo | 72/88 |

FOREIGN PATENT DOCUMENTS

| | | | |
|---|---|---|---|
| 949053 | 2/1964 | United Kingdom | 279/2 A |

*Primary Examiner*—Daniel C. Crane

*Attorney, Agent, or Firm*—Reising, Ethington, Barnard, Perry & Milton

[57] ABSTRACT

Thin-wall sleeve splining apparatus (10) is disclosed as including a loader (22) having a radially expandable mandrel (24) which is inserted within a dual ended thin-wall sleeve (14) to secure the sleeve in preparation for splining one of its ends (12,16). A rotatable loading spindle (26) supports the expandable mandrel (24) and is moved by an actuator (28) to position the sleeve over a toothed mandrel (20) whereupon a pair of toothed dies (18) are moved in opposite directions to mesh die and mandrel teeth with the sleeve therebetween to form the thin-wall splines. After the splining, the actuator (28) moves the loading spindle (26) away from the toothed mandrel (20) for unloading of the splined sleeve. In the preferred construction of the apparatus, the toothed forming dies are embodied by elongated die racks (18) that are slidably mounted by upper and lower bases (32,34) of a splining machine (30). An external collet (110) of the expandable mandrel (24) is radially expanded and contracted by a hydraulic operator (118) to provide clamping and unclamping of the sleeve. Two expandable mandrels (24,24') are disclosed to provide splining of both ends of the sleeve (14).

8 Claims, 7 Drawing Figures

APPARATUS FOR SPLINING THIN-WALL POWER TRANSMISSION SLEEVES

TECHNICAL FIELD

This invention relates to apparatus for splining thin-wall power transmission sleeves by a rolling operation.

BACKGROUND ART

U.S. Pat. No. 3,982,415, which is assigned to the assignee of the present application, discloses a rolling operation for forming splines in thin-wall sleeves of power transmission members. This rolling operation is performed by mounting the thin-wall sleeve on a toothed mandrel that is located between a pair of toothed dies. Movement of the pair of dies in opposite directions as each other meshes the die and mandrel teeth with the sleeve therebetween so as to form the splines at diametrically opposite locations while the mandrel rotates in coordination with the die movement. Vehicle automatic transmissions conventionally incorporate the type of splined sleeve formed by this rolling process which is capable of performing the splining much more economically than impact splining that was previously utilized. One embodiment of the toothed mandrel disclosed by this patent is radially expandable so as to facilitate mounting and removal of the sleeve for the splining.

U.S. Pat. No. 4,028,922, which is also assigned to the assignee of the present application, discloses dies having a particular toothed forming face construction for performing the thin-wall sleeve splining discussed above. These dies are disclosed as being either of the straight gear rack type or of a rotary type such as disclosed by U.S. Pat. No. 4,045,988 which is also assigned to the assignee of the present application.

U.S. Pat. No. 4,155,237, which is also assigned to the assignee of the present application, discloses a thin-wall sleeve splining machine of the type discussed above with an automatic loader used to mount and remove the sleeve from the mandrel. Loading and unloading members of the machine loader cooperate to move the sleeve onto the mandrel for the splining operation and to thereafter remove the splined sleeve in preparation for the next cycle.

DISCLOSURE OF INVENTION

An object of the present invention is to provide improved apparatus for forming end splines on one end of a dual ended thin-wall sleeve for transmitting torque.

In carrying out the above object, apparatus constructed in accordance with the invention includes a pair of toothed dies mounted in spaced relationship to each other for movement in opposite directions and also includes an externally toothed mandrel mounted between the dies for rotation about a central axis. A loader of the apparatus includes a radially expandable mandrel which is inserted within the sleeve and radially expanded at a location spaced from the one end thereof in order to secure the sleeve. The apparatus also includes a loading spindle on which the expandable mandrel is mounted for rotation about the central axis. An actuator of the apparatus moves the loading spindle axially to position the one end of the sleeve over the toothed mandrel such that die movement meshes the die and mandrel teeth with the sleeve end therebetween to form thin-wall splines. After the spline forming is completed, the actuator moves the loading spindle axially away from the toothed mandrel for unloading of the splined sleeve.

In the preferred construction disclosed, the apparatus includes first and second expandable mandrels for enabling both ends of the sleeve to be splined during successive splining operations. Each of the expandable mandrels includes an axially facing surface that axially engages the sleeve end opposite the sleeve end to be splined such that mounting of the sleeve on the expandable mandrel is performed in a manner that accurately locates the sleeve during the splining. One of the expandable mandrels includes an axially facing surface that engages an axial surface formed on the associated sleeve end inwardly from its extreme axial end surface, while the other expandable mandrel includes an axially facing surface that engages the extreme axial end surface of its associated sleeve end upon mounting.

The preferred construction of the expandable mandrel includes an external collet that is radially expandable and has an inwardly facing cone surface. An operator of the expandable mandrel includes an operating member having an outwardly facing cone surface that engages the cone surface on the collet to provide radial expansion and contraction of the collet upon relative axial movement between the operating member and the collet. The operator of the expandable mandrel also preferably includes a hydraulically operated piston for axially moving the operating member to radially expand and contract the collet. A spring of the expandable mandrel biases the piston thereof to provide expansion of the collet for clamping of the sleeve to be splined. Hydraulic fluid supplied to the piston provides axial movement thereof against the spring bias in order to contract the collet for unclamping of the sleeve after the thin-wall splining has been performed.

In the preferred construction disclosed, the apparatus also includes a loading member on which the loading spindle is rotatably mounted preferably by antifriction bearings. The loading member and the loading spindle cooperatively define a passage through which hydraulic fluid is fed to the hydraulic piston that controls axial movement of the piston and consequent radial expansion and contraction of the collet for securing and releasing the sleeve being splined. An actuator of the apparatus includes a cylinder that moves the loading member along the central axis toward and away from the toothed mandrel to provide the loading and unloading during the splining operation. Antifriction bearings are also utilized to rotatably support the toothed mandrel for the rotation that takes place during the splining of the sleeve.

Either the toothed mandrel or the expandable mandrel includes a central axial projection, and the other mandrel includes a central axial hole that receives the projection upon movement of the expandable mandrel toward the toothed mandrel. Cooperation of the axial projection and the axial hole provides a concentric relationship of the mandrels during the spline forming to thereby ensure precise formation of the thin-wall splines.

As disclosed, the dies are embodied by a pair of toothed die racks mounted in a spaced relationship to each other for movement in opposite directions along parallel paths. The externally toothed mandrel is mounted between the die racks for rotation about the central axis about which the splining takes place. Die rack movement meshes the die and mandrel teeth with the sleeve end therebetween to form the thin-wall splines.

A machine embodying the apparatus includes upper and lower bases defining a workspace in which the splining is performed. The pair of toothed die racks are respectively mounted on the upper and lower bases in a vertically spaced relationship to each other for movement in opposite directions along parallel paths. The externally toothed mandrel is mounted by antifriction bearings within the workspace for rotation about the central axis about which the splining is performed.

The objects, features, and advantages of the present invention are readily apparent from the following detailed description of the best mode for carrying out the invention when taken in connection with the accompanying drawings.

BEST MODE FOR CARRYING OUT THE INVENTION

Figure 1:
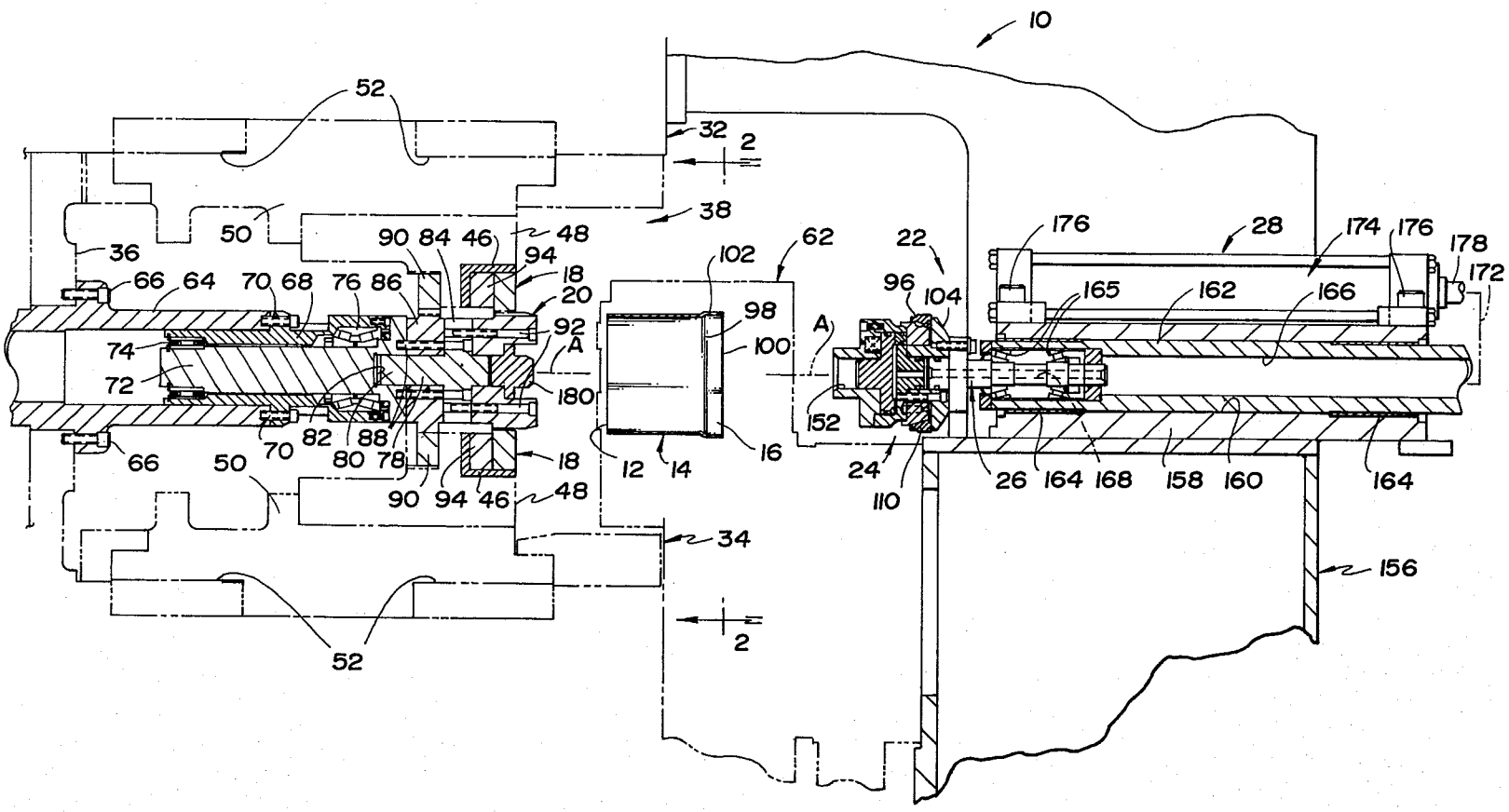
FIG. 1 is a sectional view taken in a sideways direction through thin-wall sleeve splining apparatus constructed in accordance with the present invention.
Figure 2:
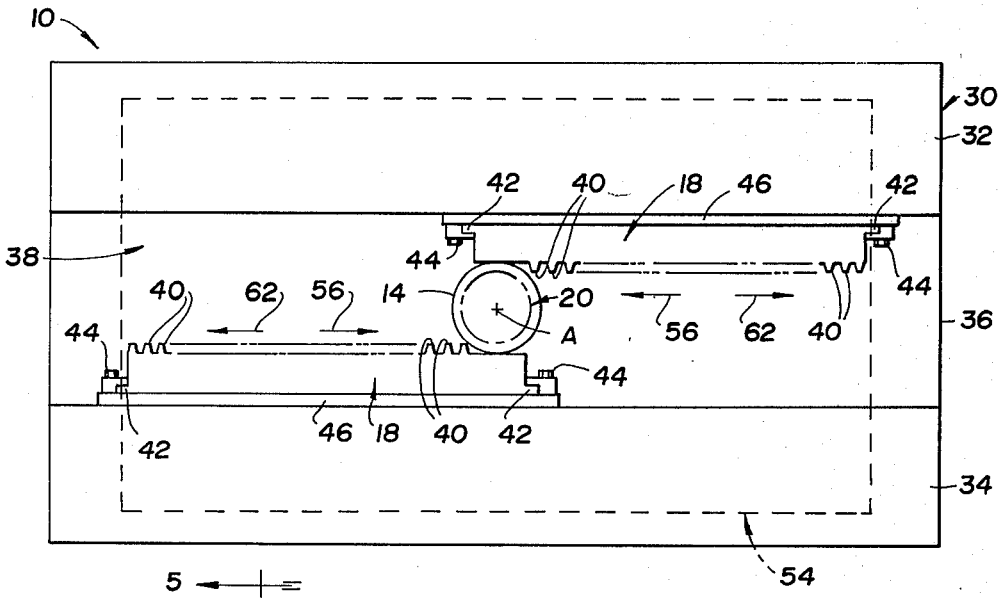
FIG. 2 is an elevation view of the apparatus taken in the direction of line 2—2 in FIG. 1.
Figure 3:
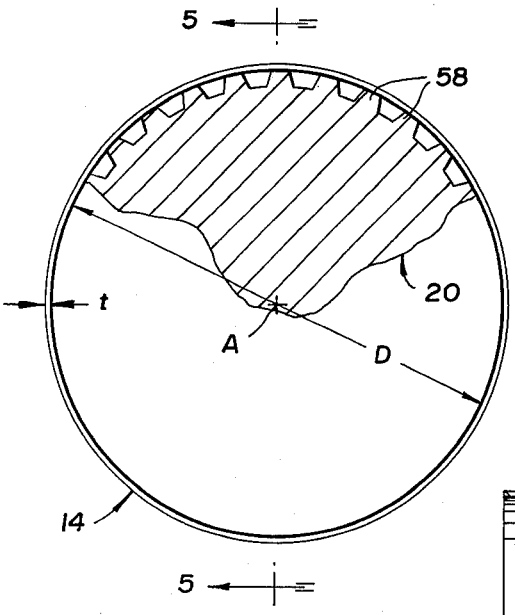
FIG. 3 is an enlarged view taken in the same direction as FIG. 2 and illustrates a toothed mandrel on which the sleeve to be splined is mounted for the spline forming operation.

Referring to FIG. 1 of the drawings, thin-wall splining apparatus constructed in accordance with the present invention is generally indicated by reference numeral 10 and is operable to form thin-wall splines in one end 12 of a thin-wall metal sleeve 14 which also has a second end 16 on which splines are formed as is hereinafter more fully described. As seen in both FIGS. 1 and 2, splining apparatus 10 includes a pair of toothed dies 18 that are mounted in a spaced relationship to each other for movement in opposite directions. An externally toothed mandrel 20 of the splining apparatus is illustrated in FIG. 3 and is mounted between the dies 18 as shown in FIGS. 1 and 2 for rotation about a central axis A. A loader 22 of the apparatus is illustrated in FIG. 1 and includes a radially expandable mandrel 24 which is inserted within the sleeve 14 and radially expanded at a location spaced from the one sleeve end 12 in order to secure the sleeve in preparation for the splining operation. A rotatable loading spindle 26 mounts the expandable mandrel 24 and is supported for rotation about the central axis A in alignment with the toothed mandrel 20. An actuator 28 of the splining apparatus moves the loading spindle 26 axially along the central axis A to position the one end of the sleeve 14 over the toothed mandrel 20 such that movement of the dies 18 meshes the die and mandrel teeth with the sleeve end 12 therebetween to form thin-wall splines. After such splining, the actuator 28 moves the loading spindle 26 axially away from the toothed mandrel 20 for unloading of the splined sleeve.

Referring to FIG. 2, a machine 30 incorporating the splining apparatus 10 includes upper and lower bases 32 and 34 that project forwardly from a rear connecting portion 36 to define a workspace 38 in which the splining is performed. Each of the upper and lower dies 18 is disclosed as an elongated die rack having teeth 40 spaced along the length thereof between its opposite ends. End retention lugs 42 of each die rack 18 are secured by associated bolted clamps 44 to a rack box 46 which is mounted as shown in FIG. 1 on a fixture 48 that is fixed on an associated slide 50. Each slide 50 is supported by a slideway 52 on the associated machine base 32 or 34. Die racks 18 are thus mounted on the upper and lower bases 32 and 34 in a vertically spaced relationship from each other.

Figure 4:
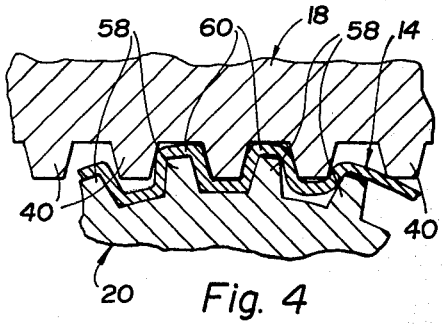
FIG. 4 is a view taken in the same direction as FIGS. 2 and 3 to illustrate the manner in which meshing of die and mandrel teeth with the sleeve therebetween forms thin-wall splines in the sleeve.

Referring to FIG. 2, a schematically indicated drive mechanism 54 of machine 30 is preferably of the type disclosed by U.S. Pat. No. 3,793,866 and initially moves the die racks 18 along parallel paths in opposite directions as each other as indicated by arrows 56 so as to engage the sleeve 14 at diametrically opposite locations on opposite sides of the central axis A. Such movement of the die racks 18 meshes the die teeth 40 and mandrel teeth 58 (FIG. 3) with the sleeve 14 therebetween in order to form thin-wall splines 60 on the end of the sleeve as illustrated in FIG. 4. Thereafter, the machine drive mechanism 54 shown in FIG. 2 moves the die racks 18 in the opposite directions shown by arrows 62 back to their original position in preparation for the next cycle.

With reference to FIG. 3, it should be noted that whereas normal engineering terminology defines a thin-wall construction as including an internal diameter "D" to wall thickness ratio "t" of at least ten, this ratio is at least twenty for the type of splining involved with this invention and normally on the order of fifty or more. For example, the internal diameter may be on the order of about 4 inches with a wall thickness of about 1/16 of an inch so as to provide a ratio of 64.

As illustrated in FIG. 1, a loading indexer 62 is positioned between the toothed mandrel 20 and the expandable mandrel 24 and is preferably of the type disclosed by U.S. Pat. No. 4,155,237. Operation of loading indexer 62 moves each sleeve 14 to be splined into alignment with the expandable mandrel 24 whereupon operation of the actuator 28 moves the expandable mandrel toward the left into the sleeve. Expansion of the mandrel 24 then secures the sleeve 14 in preparation for the splining. Actuator 28 then moves the mandrel 24 and the sleeve 14 toward the left such that the sleeve end 12 is positioned over the toothed mandrel 20 for the splining operation previously described. Thereafter, the actuator 28 moves the expandable mandrel 24 toward the right to transfer the splined sleeve 14 back to the loading indexer 62 whereupon the expandable mandrel is contracted to release the splined sleeve and is then moved farther toward the right to the position shown. Operation of the loading indexer 62 then moves the splined sleeve 14 out of alignment with the expandable mandrel 24 and concomitantly moves the next sleeve to be splined into alignment therewith in preparation for the next cycle.

With continuing reference to FIG. 1, a hollow support housing 64 is secured in a fixed relationship by bolts 66 to the machine connecting portion 36 projecting forwardly therefrom into the workspace 38. A hollow support housing extension 68 is secured by bolts 70 to support housing 64 and receives a forwardly projecting mandrel spindle 72. An antifriction roller bearing 74 and a dual row antifriction tapered roller bearing 76 cooperate to rotatably mount the mandrel spindle 72 on the support housing extension 68 for rotation about the central axis A about which the sleeve splining is performed. A mandrel adapter 78 has an end 80 received within a hole 82 in the mandrel spindle 72 and also has an annular flange 84. A mandrel synchronizing gear 86 is secured by bolts 88 to the flange 84 of the mandrel adapter 78 and is meshed with a pair of synchronizing racks 90 carried by the slide fixtures 48 on which the forming die racks 18 are also supported. The externally toothed mandrel 20 is also secured by a plurality of bolts 92 to the annular flange 84 of the mandrel adapter 78 so as to be supported thereby for rotation about the central axis A. It will be noted that rack spacers 94 position the forming die racks 18 on the rack boxes 46 so as to be aligned with the toothed mandrel 20 in order to provide the thin-wall sleeve forming as previously described. During the splining, the synchronizing gear 86 and synchronizing racks 90 cooperate to rotate the toothed mandrel 20 in coordination with the forming racks 18 to provide the tooth meshing that forms the thin-wall splines.

Figure 5:
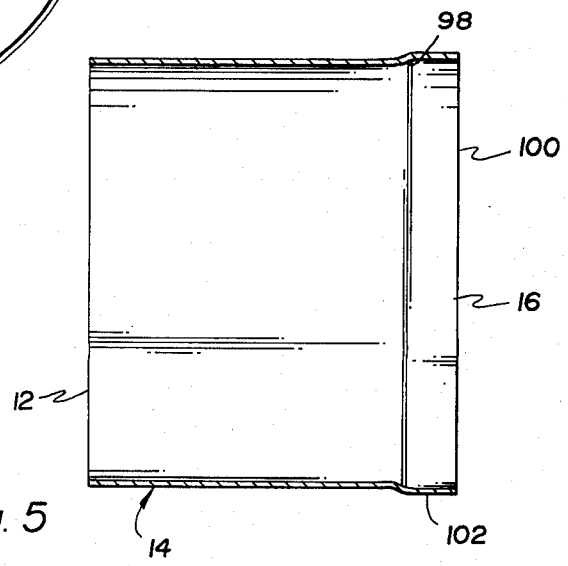
FIG. 5 is a sectional view taken along the direction of line 5—5 in FIG. 3 to illustrate the thin-wall sleeve that is splined by the apparatus.

With combined reference to FIGS. 1 and 5, the expandable mandrel 24 includes an axially facing surface 96 that engages the sleeve end 16 at an axially facing surface 98 thereof located inwardly from the extreme axial end surface 100 of the sleeve end 16. As disclosed, the sleeve end 16 is formed outwardly to provide an annular end ring 102 of a greater diameter than the rest of the sleeve with the axially facing surface 98 extending between the end ring and the rest of the sleeve. After the sleeve end 12 has been splined with the expandable mandrel 24 supporting the sleeve end 16 during the splining, the splined end 12 is then supported by another expandable mandrel 24' shown in FIG. 6 in preparation for forming thin-wall splines 60 on the sleeve end 16. To facilitate production, normally there will be two machines, one of which is utilized to provide the splining of the sleeve end 12 and the other of which is used to provide the splining of the sleeve end 16. Thus, the mandrel 24 shown in FIG. 1 will be mounted on one of the machines while the mandrel 24' shown in FIG. 6 will be mounted on the other machine.

Figure 6:
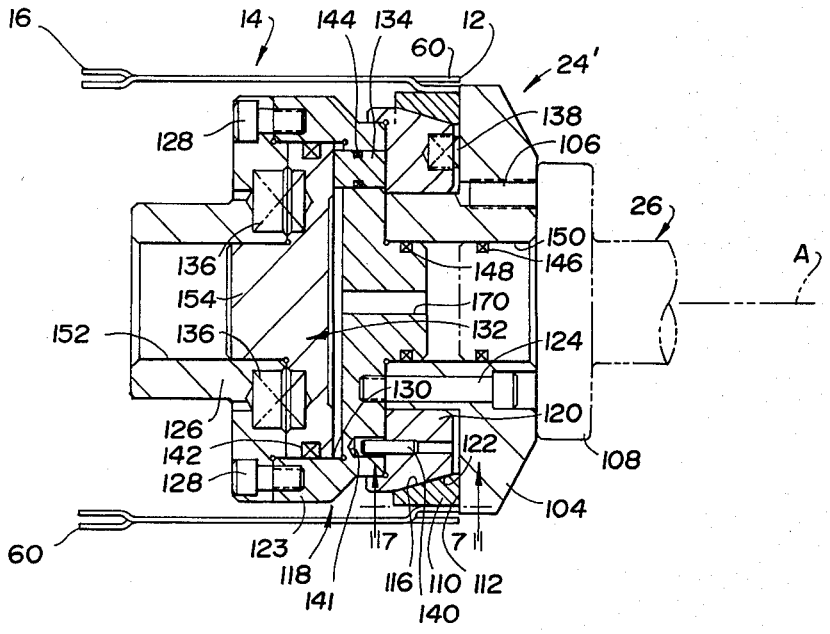
FIG. 6 is a sectional view of a second expandable mandrel that is used in cooperation with an expandable mandrel shown in FIG. 1 to form thin-wall splines on both ends of the sleeve during successive splining operations.
Figure 7:
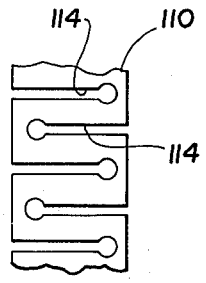
FIG. 7 is a radial view taken along the direction of line 7—7 in FIG. 6 to illustrate the construction of an external collet of the expandable mandrel.

Expandable mandrel 24 shown in FIG. 1 and the expandable mandrel 24' shown in FIG. 6 have generally the same construction as each other, except as will be noted, and thus will be described together with like reference numerals applied to like components of each mandrel. As illustrated in FIG. 6, each expandable mandrel includes an adapter 104 that is secured by a plurality of circumferentially spaced bolts 106 (only one shown) to an annular flange 108 of the loading spindle 26. An external collet 110 of the expandable mandrel has an annular configuration and is engaged with an axially facing surface 112 on the adapter 104. As illustrated in FIG. 7, collet 112 has axially extending slots 114 extending alternately from its opposite axial sides so as to be radially expandable to provide sleeve end clamping upon insertion into the sleeve as illustrated in FIG. 6.

As seen in FIG. 6, the collet 110 of mandrel 24' has a slightly smaller diameter than the axially facing surface 112 on the adapter 104 such that the adapter axially engages the sleeve end 12 to provide proper positioning thereof in preparation for the splining operation on the other sleeve end 16. Collet 110 of mandrel 24 shown in FIG. 1 has a slightly larger size than the adapter 104 and defines the axially facing surface 96 that engages the axial sleeve end surface 98 as previously described. Such axial engagement of each mandrel with the sleeve 14 accurately locates the sleeve during the splining operation.

External collet 110 shown in FIG. 6 has an inwardly facing cone surface 116 that converges toward the right in a concentric relationship with the central axis A about which the loading spindle 26 is rotatably supported. An operator 118 of the expandable mandrel includes an operating member 120 that is located within the collet 110 and has an outwardly facing cone surface 122 engaged with the cone surface 116 on the collet. As is hereinafter more fully described, mandrel operator 118 moves the operating member 120 axially to provide radial expansion and contraction of collet 110. Movement of the operating member 120 toward the right provides the radial expansion of the collet 110 in order to provide clamping of the sleeve 14 for the thin-wall splining. Thereafter subsequent to completion of the splining, the operating member 120 is moved toward the left in order to provide contraction of the collet 110 for unclamping of the sleeve 14.

With continuing reference to FIG. 6, the operator 118 of the expandable mandrel also includes a housing having a first member 123 that is secured by a plurality of bolts 124 (only one shown) to the mandrel adapter 104. A second member 126 of the mandrel housing is secured by a plurality of bolts 128 to the first housing member 123 to cooperate therewith in defining a piston chamber 130. Operator 118 also includes a hydraulically operated piston 132 that is received within the chamber 130 defined by the housing members 123 and 126. A plurality of circumferentially spaced piston extensions 134 (only one shown) extend from the piston 132 to engage the operating member 120 in order to provide movement thereof in response to movement of the piston. A plurality of helical springs 136 bias the piston 132 toward the right in order to provide the axial movement of the operating member 120 toward the right for expansion of the collet 110.

Upon hydraulically actuated movement of the piston 132 toward the left as viewed in FIG. 6, a plurality of circumferentially spaced helical springs 138 (only one shown) extending between the adapter 104 and the operating member 120 provide movement of the operating member toward the left in order to permit contraction of the collet 110 for unclamping of the sleeve after the splining has been performed. A guide pin 140 on the operating member 120 extends into a hole 141 in the first housing member 123 in order to guide movement and prevent rotation of the operating member with respect to the housing and the collet. Suitable keys may also be provided between the collet 110 and both the adapter 104 and the operating member 120 in order to prevent relative rotation of the collet.

Piston 132 of the expandable mandrel shown in FIG. 6 includes an annular seal 142 and its extension 134 includes a seal 144 so as to prevent leakage of hydraulic fluid during operation which is more fully hereinafter described. Loading spindle 26 and the first housing member 123 include associated annular seals 146 and 148 which are engaged with the mandrel adapter 104 within a central hole 150 through which the central axis A extends. Also, the second housing member 126 of the expandable mandrel includes a central hole 152 that receives a guide 154 of the piston 132 to provide a guiding action thereto during the piston movement.

With reference to FIG. 1, a loader base 156 is mounted in front of the indexer 62 and supports a hollow slideway 158 that defines a central opening 160 aligned with the central axis A of rotation. A loading member 162 which preferably has a tubular shape is received within the slideway opening 160 and is supported by a pair of bushings 164 for axial movement that moves the expandable mandrel 24 toward the left and the right as previously described. At its left end, loading member 162 includes a pair of tapered antifriction roller bearings 165 that rotatively support the loading spindle 26 on which the expandable mandrel 24 is mounted. The interior 166 of loading member 162 and a central axial hole 168 through the loading spindle 26 cooperate to define a passage through which hydraulic fluid is fed from a suitable source to control movement of the hydraulic piston. As best seen in FIG. 6, this hydraulic fluid is fed through a hole 170 in the first housing member 123 of the expandable mandrel to operate the piston 132 in the manner previously described.

With reference back to FIG. 1, the right end of the loading member 162 has a suitable schematically indicated connection 172 to the actuator 28 which preferably includes a cylinder 174 that is mounted on top of the slideway 158 and secured thereto by bolts 176. Cylinder 174 has a piston connecting rod 178 that extends outwardly therefrom and is secured to the connection 172 to the loading member 162. As such, extension and retraction of the cylinder rod 178 moves the loading member 162 to provide axial movement of the expandable mandrel 24.

As seen in FIG. 1, the toothed mandrel 20 includes a projection 180 that is received within the central axial hole 152 in the expandable mandrel 24 upon movement of the expandable mandrel toward the left for loading of the sleeve 14 in preparation for the splining operation previously described. This inserted relationship of the toothed mandrel projection 180 into the hole 152 of the expandable mandrel 24 provides a concentric relationship of the mandrels during the spline forming to ensure precision in the thin-wall splines that are produced. Of course, it is possible to reverse the respective positions of the projection and the hole on the two mandrels and still produce the same concentric relationship of the two mandrels.

While the best mode for carrying out the invention has been described in detail, those familiar with the art to which this invention relates will recognize various alternative designs and embodiments for practicing the invention as defined by the following claims.

What is claimed is:

1. Apparatus for forming end splines on one end of a dual ended thin-wall sleeve for transmitting torque, said apparatus comprising: a pair of toothed dies mounted in spaced relationship to each other for movement in opposite directions; an externally toothed mandrel mounted between the dies for rotation about a central axis including first mating means extending axially therefrom; a loader including a radially expandable mandrel which is inserted within the sleeve and radially expanded at a location spaced from said end thereof in order to secure the sleeve, said loader including second mating means axially spaced from said expandable mandrel and extending axially away from said expandable mandrel for mating with said first mating means between said mandrels and within the sleeve secured to said expandable mandrel to provide a concentric relationship between said mandrels during splining; a rotatable loading spindle on which the expandable mandrel is mounted for rotation about said central axis; and an actuator that moves the loading spindle axially to position said one end of the sleeve over the toothed mandrel such that die movement meshes the die and mandrel teeth with the sleeve end therebetween to form thin-wall splines whereupon the actuator moves the loading spindle axially away from the toothed mandrel for unloading of the splined sleeve.

2. Apparatus as in claim 1 wherein the expandable mandrel includes an axially facing surface that axially engages the other end of the sleeve upon mounting thereon for the splining.

3. Apparatus as in claim 1 wherein the expandable mandrel includes an external collet that is radially expandable and has an inwardly facing cone surface, the expandable mandrel including an operator having an operating member, and said operating member having an outwardly facing cone surface that engages the cone surface on the collet to provide radial expansion and contraction of the collet upon relative axial movement between the operating member and the collet.

4. Apparatus as in claim 3 wherein the operator for the expandable mandrel includes a hydraulically operated piston for axially moving the operating member to radially expand and contract the collet.

5. Apparatus as in claim 4 which includes a loading member on which the loading spindle is rotatably mounted, the loading member and the loading spindle cooperatively defining a passage through which hydraulic fluid is fed to the piston to control axial movement thereof and consequent radial expansion and contraction of the collet, and the actuator including a cylinder that moves the loading member and expandable mandrel having the sleeve secured thereon along the central axis toward and away from the toothed mandrel to provide sleeve loading and unloading.

6. Apparatus as in claim 1 or 5 wherein one of the mandrels includes a central axial projection and the other mandrel includes a central axial hole that receives the projection upon movement of the expandable mandrel toward the toothed mandrel defining said first and second mentioned mating means to thereby provide a concentric relationship of the mandrels during the spline forming.

7. Apparatus for forming end splines on one end of a dual ended thin-wall sleeve for transmitting torque, said apparatus comprising: upper and lower bases defining a workspace; a pair of toothed die racks respectively mounted on the upper and lower bases in a vertically spaced relationship to each other for movement in opposite directions; an externally toothed mandrel; antifriction bearings for mounting the toothed mandrel within the workspace between the die racks for rotation about a central axis; a loader including a radially expandable mandrel which in inserted within the sleeve and radially expanded at a location spaced from said one end thereof in order to secure the sleeve; said expandable mandrel including an external collet that is radially expandable and has an inwardly facing cone surface; an operator including an operating member having an outwardly facing cone surface that engages the cone surface on the collet; a hydraulically operated piston that moves the operating member axially to expand and contract the collet; a rotatable loading spindle on which the expandable mandrel is mounted for rotation about said central axis; an actuator including a loading member axially movable along the central axis toward and away from the toothed mandrel; antifriction bearings that rotatably support the loading spindle on the loading member; a cylinder that moves the loading member and hence the loading spindle including the expandable mandrel having the sleeve secured thereon axially to position said one end of the sleeve over the toothed mandrel such that die rack movement meshes the die and mandrel teeth with the sleeve end therebetween to form thin-wall splines whereupon the actuator moves the loading member and the loading spindle axially away from the toothed mandrel for unloading of the splined sleeve; one of the mandrels including a central axial projection mounted thereon between said mandrels; and the other mandrel including a central axial hole axially spaced from said mandrel to be disposed between said mandrels for receiving the projection within the sleeve secured on said other mandrel to provide a concentric reationship of the mandrels during the thin-wall splining.

8. Apparatus for forming end splines on one end of a dual ended thin-wall sleeve for transmitting torque, said apparatus comprising: upper and lower bases defining a workspace; a pair of toothed die racks respectively mounted on the upper and lower bases in a vertically spaced relationship to each other for movement in opposite directions; an externally toothed mandrel; antifriction bearings for mounting the toothed mandrel within the workspace between the die racks for rotation about a central axis; a loader including a radially expandable mandrel which is inserted within the sleeve and radially expanded at a location spaced from said one end thereof in order to secure the sleeve; said expandable mandrel including an external collet that is radially expandable and has an inwardly facing cone surface; an operator including an operating member having an outwardly facing cone surface that engages the cone surface on the collet; a hydraulic piston that moves the operating member to the control radial expansion and contraction of the collet; a spring for moving the hydraulic piston in one axial direction to move the operating member in order to radially expanded the collet; a hydraulic passage for feeding pressurized hydraulic fluid to the piston to provide axial movement thereof in opposite axial direction as the spring so as to radially contract the collet; a rotatable loading spindle on which the expendable mandrel is mounted for rotation about said central axis; an actuator including a loading member axially movable along the central axis toward and away from the toothed mandrel; anti-frication bearings that rotatably support the loading spindle on the loading member; a cylinder that moves the loading member and hence the loading spindle including the expandable mandrel having the sleeve secured thereon axially to position said one end of the sleeve over the toothed mandrel such that die rack movement meshes the die and mandrel teeth with the sleeve end therebetween to form thin-wall splines whereupon the actuator moves the loading member and the loading spindle axially away from the toothed mandrel for unloading of the splined sleeve; one of said mandrels including a central axial projection mounted thereon between said mandrels; and the other mandrel including a central axial hole axially spaced from said mandrel to be disposed between said mandrels for receiving the projection within the sleeve secured on said other mandrel to provide a concentric relationship of the mandrels during the thin-wall splining.

* * * * *